US007654653B2

(12) United States Patent
Ito

(10) Patent No.: US 7,654,653 B2
(45) Date of Patent: Feb. 2, 2010

(54) INK-JET HEAD

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 528 days.

(21) Appl. No.: 11/671,893

(22) Filed: Feb. 6, 2007

(65) Prior Publication Data

US 2007/0182790 A1 Aug. 9, 2007

(30) Foreign Application Priority Data

Feb. 7, 2006 (JP) ..... 2006-029485

(51) Int. Cl.
*B41J 2/045* (2006.01)
*B41J 29/38* (2006.01)

(52) U.S. Cl. ..... 347/71; 347/17

(58) Field of Classification Search ..... 347/17, 347/68, 70–72

See application file for complete search history.

(56) References Cited

U.S. PATENT DOCUMENTS 5,622,897 A * 4/1997 Hayes ..... 438/21
6,386,672 B1 * 5/2002 Kimura et al. ..... 347/18
2005/0140741 A1 6/2005 Kubo

FOREIGN PATENT DOCUMENTS

JP 2005178306 A 7/2005

* cited by examiner

*Primary Examiner*—An H Do
(74) *Attorney, Agent, or Firm*—Baker Botts L.L.P.

(57) ABSTRACT

An ink-jet head according to the present invention includes a wire member and a heat sink. The wire member has a substrate on a surface of which a driver IC chip is mounted. The heat sink is made of a metal material, in contact with the driver IC chip, and dissipates heat generated in the driver IC chip to outside. A first wire and a second wire are formed on the surface of the substrate of the wire member. The first and second wires are electrically connected to an individual electrode and a common electrode of a piezoelectric actuator, respectively. The second wire is formed along an outer edge of the substrate, and electrically connected and thermally coupled to the heat sink.

6 Claims, 13 Drawing Sheets

INK-JET HEAD

CROSS-REFERENCE TO RELATED APPLICATION

This application claims priority to and the benefit of Japanese Patent Application No. 2006-029485 filed on February 7, 2006, the disclosure of which is incorporated herein by reference.

BACKGROUND OF THE INVENTION

1. Field of the Invention

The present invention relates to an ink-jet head that ejects an ink droplet through an ink ejection port.

2. Description of Related Art

In an ink-jet head, a piezoelectric actuator applies pressure to ink contained in a pressure chamber to thereby eject an ink droplet through an ink ejection port that communicates with the pressure chamber. The ink-jet head of this type is sometimes provided with a heat sink for dissipating to outside heat generated in a driver IC chip that drives the piezoelectric actuator. For example, Japanese Patent Unexamined Publication No. 2005-178306 discloses a recording head in which a flexible wiring cable mounted with an IC chip is laminated on an upper face of a piezoelectric actuator, and the IC chip is in contact with a side wall of a heat sink. This enables heat to be transferred from the IC chip to the heat sink.

SUMMARY OF THE INVENTION

In the recording head disclosed in the above-mentioned document, however, the flexible wiring cable is merely in contact with the heat sink via the IC chip. Accordingly, heat generated in a wire that is formed on a surface of the flexible wiring cable may not sufficiently be dissipated to outside. In addition, noise generated in a wiring that is formed on the surface of the flexible wiring cable may undesirably be radiated to outside.

An object of the present invention is to provide an ink-jet head that enables heat generated in a driver IC chip and in a wire member to be efficiently dissipated to outside, and at the same time can suppress radiation of noise.

According to an aspect of the present invention, there is provided an ink-jet head comprising a passage unit, a piezoelectric actuator, a wire member, and a heat sink. The passage unit has a pressure chamber that communicates with an ink ejection port. The piezoelectric actuator applies pressure to ink in the pressure chamber, and has an individual electrode formed so as to be opposed to the pressure chamber, a common electrode formed so as to be opposed to the individual electrode, and a piezoelectric layer sandwiched between the individual electrode and the common electrode. The wire member has a substrate, a first wire that is formed on a surface of the substrate and electrically connected to the individual electrode, a second wire that is formed on the surface of the substrate and electrically connected to the common electrode, and a driver IC chip that is mounted on the surface of the substrate, gives a drive potential to the individual electrode through the first wire, and maintains the common electrode at a predetermined reference potential through the second wire. The heat sink is made of a metal material, and is in contact with the driver IC chip and dissipates heat generated in the driver IC chip to outside. The second wire is formed along an outer edge of the substrate, and electrically connected and thermally coupled to the heat sink.

In the above aspect, the second wire is thermally coupled to the metal-made heat sink that is in contact with the driver IC chip. Therefore, heat generated in the driver IC chip and the wire member can efficiently be dissipated to outside through the heat sink. In addition, the second wire is formed along the outer edge of the wire member, and electrically connected to the metal-made heat sink. Consequently, the second wire functions as a shield that can suppress radiation of noise generated in the wire member.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described.

Figure 1:
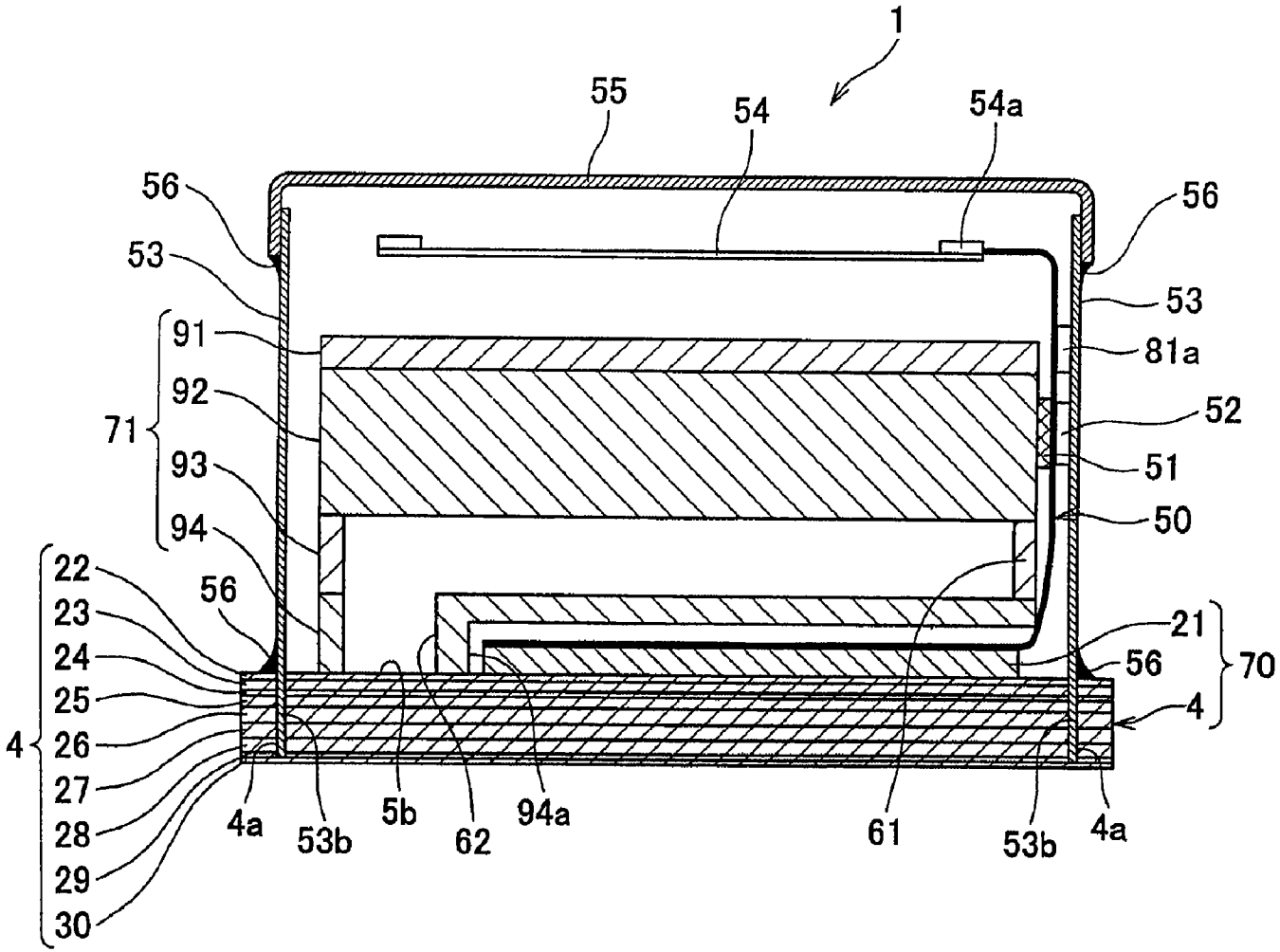
FIG. 1 is a sectional view of an ink-jet head according to an embodiment of the present invention.

FIG. 1 shows a schematic construction of an ink-jet head according to an embodiment of the present invention. As shown in FIG. 1, an ink-jet head 1 includes a head main body 70, a reservoir unit 71, a COF (Chip On Film) 50 as a wire member, a circuit board 54, two side plates 53, and an over plate 55. The head main body 70 includes a passage unit 4 and a piezoelectric actuator 21. The reservoir unit 71 is disposed on an upper face of the head main body 70, and supplies ink to the head main body 70. The COF 50 is, on its surface, mounted with a driver IC chip 52 that drives the piezoelectric actuator 21. The circuit board 54 is electrically connected to the COF 50. The side plates 53 and the over plate 55 cover the piezoelectric actuator 21, the reservoir unit 71, the COF 50, and the circuit board 54, thus preventing ink or ink mist from entering the ink-jet head 1 from outside. In addition, the side plates 53 and the over plate 55 also function as a heat sink that dissipates to outside heat generated in the driver IC chip 52 and in the COF 50, which will be described later.

Figure 2:
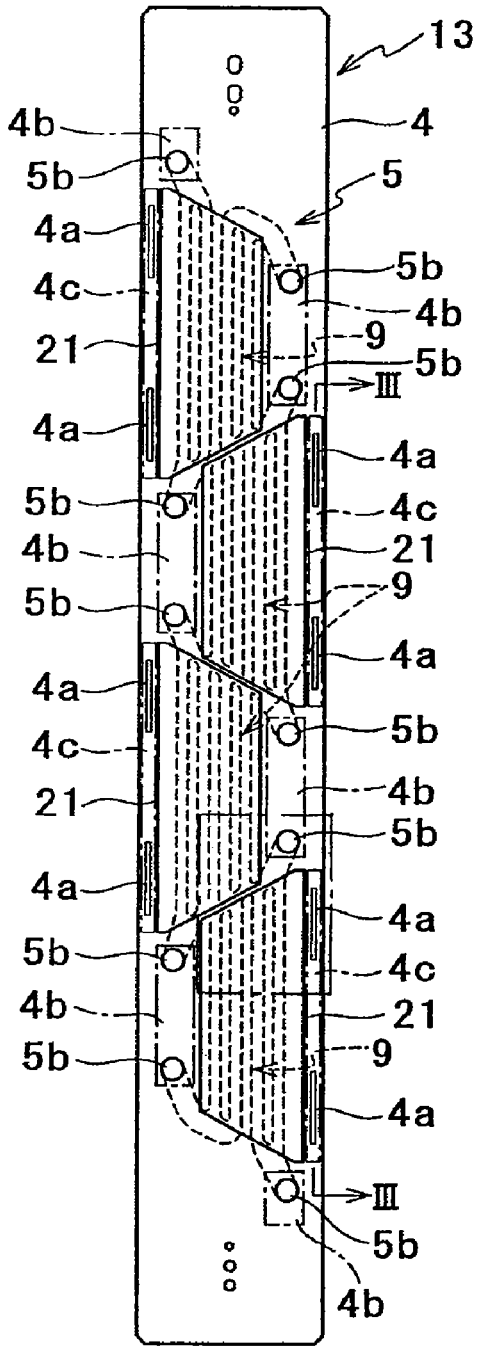
FIG. 2 is a plan view of a head main body illustrated in FIG. 1.

FIG. 2 is a plan view of the head main body 70 illustrated in FIG. 1. Formed within the passage unit 4 are later-described ink passages, among which only manifold channels 5 and sub manifold channels 5*a* that is branch passages of the manifold channels 5 are illustrated in FIG. 2 with broken lines. Other ink passages that communicate with the manifold channels 5 and the sub manifold channels 5*a* are not shown in FIG. 2. The head main body 70 is made up of the passage unit 4 and the piezoelectric actuators 21 disposed on an upper face of the passage unit 4. As shown in FIGS. 1 and 2, ten ink supply ports 5*b*, through which ink is supplied to the ink passages, are formed on the upper face of the passage unit 4. As shown in FIG. 2, the ten ink supply ports 5*b* are formed in six ink supply port placement regions 4*b* which are provided on the upper face of the passage unit 4 along a longitudinal direction of the passage unit 4, i.e., along a vertical direction in FIG. 2. The six ink supply port placement regions 4*b* are disposed alternately at opposite end portions of the passage unit 4 with respect to a widthwise direction of the passage unit 4, i.e., with respect to a horizontal direction in FIG. 2. There is one ink supply port 5*b* in, among the six ink supply port placement regions 4*b*, each of the two ink supply port placement regions 4*b* disposed at both ends with respect to the longitudinal direction of the passage unit 4. Two ink supply ports 5*b* are formed in each of the other four ink supply port placement regions 4*b*.

As shown in FIG. 2, the passage unit 4 has a total of eight grooves 4*a*. At each widthwise end portion of the passage unit 4, four of the eight grooves 4*a* are formed along the longitudinal direction of the passage unit 4. Two of the eight grooves 4*a* are paired, and one pair is formed in each of four groove placement regions 4*c*. The four groove placement regions 4*c* are disposed at widthwise end portions of the passage unit 4 in such a manner that they locate exactly opposite to the respective four ink supply port placement regions 4*b* each having two ink supply ports 5*b* formed therein. Thus, both of the ink supply port placement regions 4*b* and the groove placement regions 4*c* are arranged at both widthwise end portions of the passage unit 4, in a zigzag pattern along the longitudinal direction of the passage unit 4.

As seen from FIG. 1, the groove 4*a*, a side face of the reservoir unit 71, and the ink supply port 5*b* are sequentially disposed in this order from outside toward inside of the passage unit 4 with respect to the widthwise direction of the passage unit 4. The side plate 53 is standingly disposed corresponding to the groove 4*a*. There is a gap between the side plate 53 and the side face of the reservoir unit 71. With respect to the widthwise direction of the passage unit 4, the groove 4*a* and the ink supply port 5*b* are spaced from each other at a distance including this gap. Accordingly, when seen in the longitudinal direction, the groove 4*a* and the ink supply port 5*b* are not aligned on the same line. This can suppress the passage unit 4 from excessively deteriorating in rigidity. In addition, as will be described later, the COF 50 can easily extend upward by passing through the gap between the side plate 53 and a side face of the reservoir unit 71.

The reservoir unit 71 is disposed on the upper face of the head main body 70 so that the piezoelectric actuator 21 is sandwiched between the reservoir unit 71 and the passage unit 4. The reservoir unit 71 is fixed to the upper face of the head main body 70 substantially via the ink supply port placement region 4*b*. As will be described later, ink is supplied to the passage unit 4 through a hole 62 that communicates with the ink supply port 5*b*. A widthwise length of the reservoir unit 71, i.e., a length along the horizontal direction in FIG. 1, is shorter than that of the passage unit 4. With respect to the horizontal direction in FIG. 1, the reservoir unit 71 locates inner than the grooves 4*a*.

As shown in FIG. 1, the COF 50 is disposed so as to connect the circuit board 54 provided above the reservoir unit 71 to the piezoelectric actuator 21 provided on the upper face of the passage unit 4. The COF 50 is bonded to an upper face of the piezoelectric actuator 21. The COF 50 extends upward through between the side plate 53 and the side face of the reservoir unit 71, and is connected to a connector 54*a* of the circuit board 54. The circuit board 54 controls operation of the driver IC chip 52 that is mounted on the COF 50. The piezoelectric actuator 21 is driven by the driver IC chip 52.

In the gap between the side plate 53 and the side face of the reservoir unit 71, a surface of the COF 50 having the driver IC chip 52 provided thereon is opposed to a surface of the side plate 53. A surface of the driver IC chip 52 is in contact with the surface of the side plate 53, while an end portion of a protrusion 81*a* of the COF 50, which will be described later, is bonded to the surface of the side plate 53. Further, a surface of the COF 50 opposite to its surface having the driver IC chip 51 provided thereon is, in its portion corresponding to the driver IC chip 52, in contact with a sponge 51 of an elastic body. The sponge 51 is bonded to a later-described surface of a filter plate 92 of the reservoir unit 71. The sponge 51 presses the driver IC chip 52 to the side plate 53, thereby providing suitable thermal coupling between the driver IC chip 52 the side plate 53.

Figure 3:
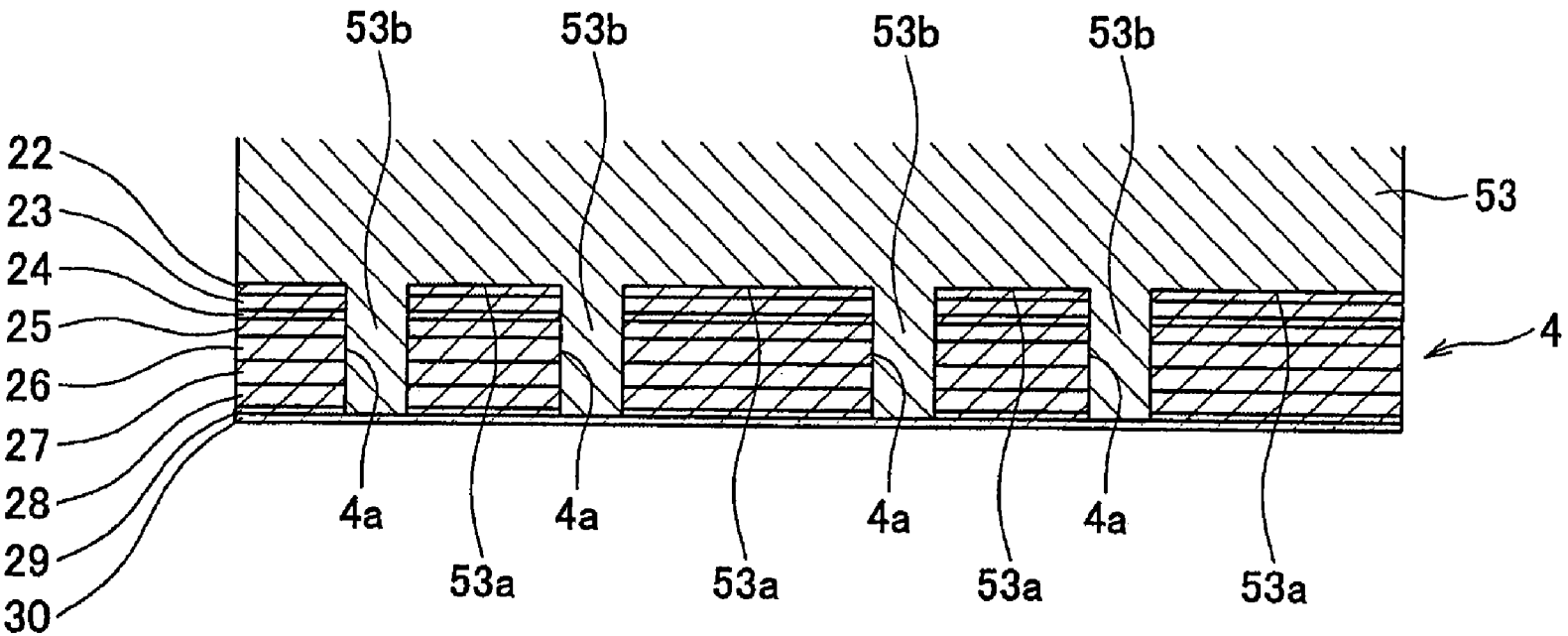
FIG. 3 is a sectional view taken along line III-III in FIG. 2.

The side plate 53 is made of a metal material, and is a plate-like member having a substantially rectangular shape extending in a vertical direction in FIG. 1 and in the longitudinal direction of the passage unit 4, i.e., the vertical direction in FIG. 2 or a horizontal direction in FIG. 3. As shown in FIG. 3, the side plate 53 has, at its lower end, peripheral linear portions 53*a* and protruding portions 53*b*. The peripheral linear portions 53*a* are in parallel with and in contact with the upper face of the passage unit 4. The protruding portions 53*b* correspond to the respective grooves 4*a*. FIG. 3 is a sectional view taken along line III-III in FIG. 2. The protruding portions 53*b* are fitted with the respective grooves 4*a* of the passage unit 4, so that the side plate 53 is fixed to the passage unit 4. Here, the peripheral linear portions 53*a* of the side plate 53 are in close contact with the upper face of the passage unit 4. Therefore, ink or ink mist cannot go inside through a gap between them.

As shown in FIG. 1, further, a sealing member 56 made of a silicone resin material is applied so as to span the upper face of the passage unit 4 and an outer face of the side plate 53. Thus, a little gap appearing between the upper face of the passage unit 4 and the linear portions 53*a* of the side plate 53 in contact therewith can be sealed up. This can surely prevent ink or ink mist from entering from outside, and at the same time can surely fix the side plate 53 to the passage unit 4. Since, as described above, the peripheral linear portions 53*a* of the side plate 53 are in close contact with the upper face of the passage unit 4, the sealing member 53 does not flow into inside through a gap between the side plate 53 and the upper face of the passage unit 4. Therefore, the sealing member 53 is prevented from reaching the piezoelectric actuator 21 and hindering operation of the piezoelectric actuator 21.

At both widthwise end portions of the passage unit 4, the two side plates 53 extend in the longitudinal direction of the passage unit 4 substantially throughout an entire longitudinal region of the passage unit 4. The two side plates 53 also extend in the vertical direction, to a position higher than the reservoir unit 71 and the circuit board 54. With respect to the widthwise direction of the passage unit 4, the reservoir unit 71, the COF 50, and the circuit board 54 are disposed between the two side plates 53. The over plate 55 is made of the same metal material as the side plate 53 is. The over plate 55 is disposed so as to cover upper ends of the side plates 53. The over plate 55 also covers both longitudinal end portions of the passage unit 4. As a consequence, the reservoir unit 71, the COF 50, and the circuit board 54 are housed in a space enclosed with the side plates 53 and the over plate 55. As shown in FIG. 1, a sealing members 56 is also applied from outside to a portion where the side plate 53 and the over plate 55 are fitted with each other, thus more surely preventing ink or ink mist from entering from outside. As shown in FIG. 1, the side plates 53 and the over plate 55 do not locate outside of the passage unit 4 with respect to the widthwise direction of the passage unit 4. Therefore, even when several ink-jet heads 1 are arranged, a compact arrangement can be realized as a whole.

Figure 4:
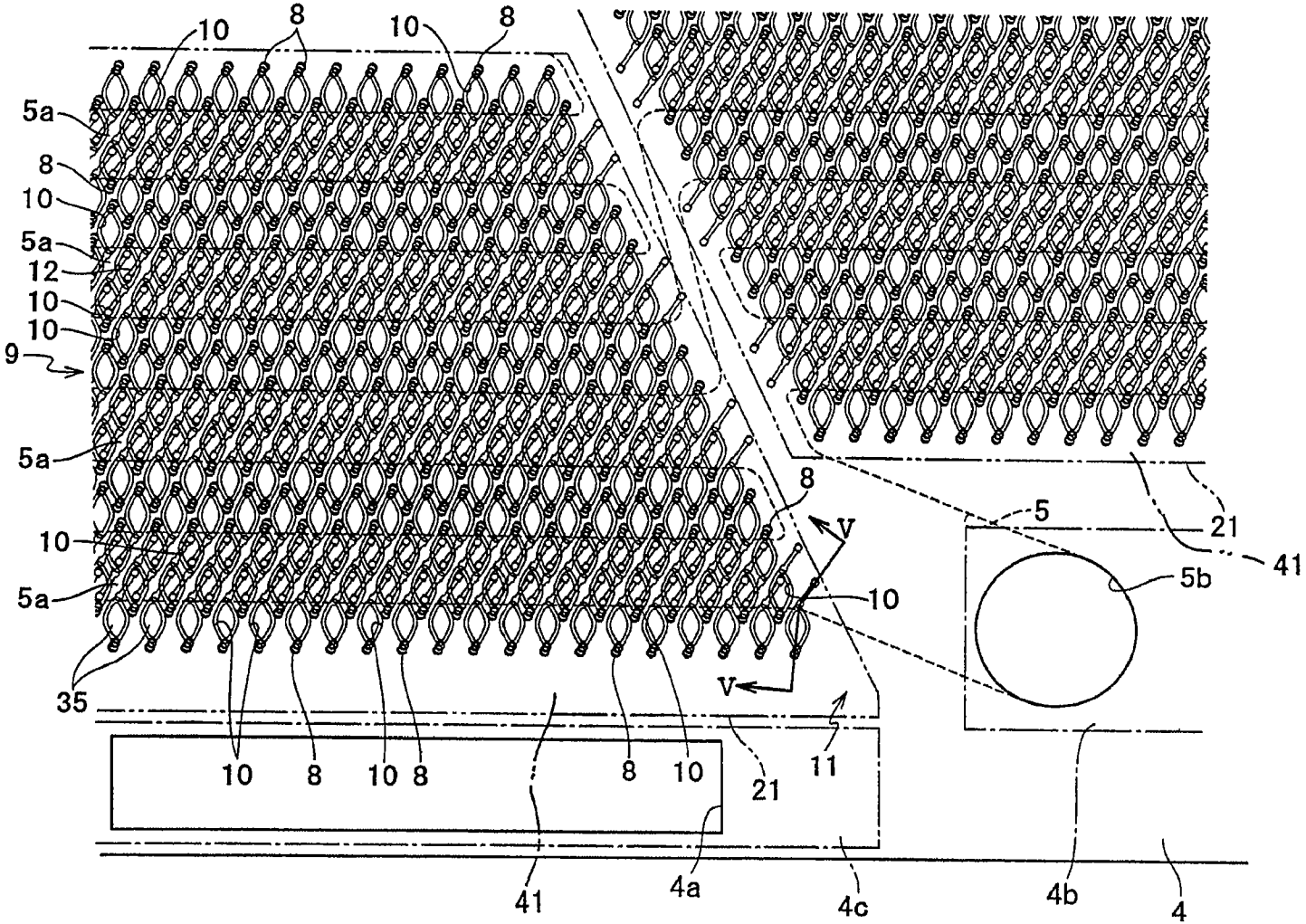
FIG. 4 shows a part of FIG. 2 on an enlarged scale.

Next, the head main body 70 will be described in more detail with reference to FIGS. 2 and 4. FIG. 4 is a plan view on an enlarged scale of a region enclosed by an alternate long and short dash line in FIG. 2. As shown in FIGS. 2 and 4, the head main body 70 has the passage unit 4 in which many pressure chambers 10 and many nozzles 8 are formed. The many pressure chambers 10 form four pressure chamber groups 9. The many nozzles 8 communicate with the respective pressure chambers 10. Four piezoelectric actuators 21 each having a trapezoidal shape are bonded to the upper face of the passage unit 4. The four piezoelectric actuators 21 are arranged in two rows in a zigzag pattern. To be more specific, each of the piezoelectric actuators 21 is disposed with its parallel opposed sides, i.e., upper and lower sides, extending along the longitudinal direction of the passage unit 4. In addition, oblique sides of every neighboring piezoelectric actuators 21 overlap with respect to the widthwise direction of the passage unit 4.

A lower face of the passage unit 4 is, in its region corresponding to where each piezoelectric actuator 21 is bonded, an ink ejection region. As shown in FIG. 4, the many nozzles 8 are regularly arranged on a surface of the ink ejection region. On the upper face of the passage unit 4, the many pressure chambers 10 are arranged in a matrix. On the upper face of the passage unit 4, one pressure chamber group 9 is made up of pressure chambers 10 that exist in a region corresponding to where one piezoelectric actuator 21 is bonded. As will be described later, one individual electrode 35 formed on the piezoelectric actuator 21 is opposed to each pressure chamber 10. In this embodiment, pressure chambers 10 disposed at regular intervals in the longitudinal direction of the passage unit 4 form a row, and there are sixteen rows parallel to each other with respect to the widthwise direction of the passage unit 4. The number of pressure chambers 10 included in each pressure chamber row gradually decreases from a longer side to a shorter side of the piezoelectric actuator 21, in conformity with an outer shape of the piezoelectric actuator 21. The nozzles 8 are arranged in the same manner as described above. Thus, as a whole, an image can be formed at a resolution of 600 dpi.

Formed within the passage unit 4 are manifold channels 5 acting as common ink chambers and sub manifold channels 5*a* acting as branch passages of the common ink chambers. The manifold channel 5 extends along the oblique side of the piezoelectric actuator 21 and intersects the longitudinal direction of the passage unit 4. Each manifold channel 5 branches into sub manifold channels 5*a* on its both sides with respect to the longitudinal direction of the passage unit 4. Sub manifold channels 5*a* branched from one manifold channel 5 are disposed in such a manner that neighboring ink ejection regions are opposed to these sub manifold channels 5*a*. One ink ejection region is opposed to four sub manifold channels 5*a* which extend in the longitudinal direction of the passage unit 4. Through ink supply ports 5*b* formed on the upper face of the passage unit 4 as described above, ink is supplied to the manifold channels 5.

Each of the nozzles 8 communicates with a sub manifold channel 5*a* through a pressure chamber 10 having a substantially rhombic shape in a plan view and an aperture 12 acting as a throttle. Nozzles 8 included in four neighboring nozzle rows, which extend in the longitudinal direction of the passage unit 4 and are arranged side by side in the widthwise direction of the passage unit 4, communicate with the same one sub manifold channel 5*a*. In FIG. 4, for the purpose of easy understanding, the piezoelectric actuators 21 are illustrated with alternate long and two short dashes lines, while pressure chambers 10 (pressure chamber groups 9) and apertures 12, which locate under the piezoelectric actuators 21 and therefore actually should be illustrated with broken lines, are illustrated with solid lines.

The many nozzles 8 formed in the passage unit 4 are positioned in such a manner that their projective points on an imaginary line extending in the longitudinal direction of the passage unit 4 can be arranged at regular intervals of 600 dpi, when these nozzles 8 are projected onto the imaginary line in a direction perpendicular to the imaginary line.

Figure 5:
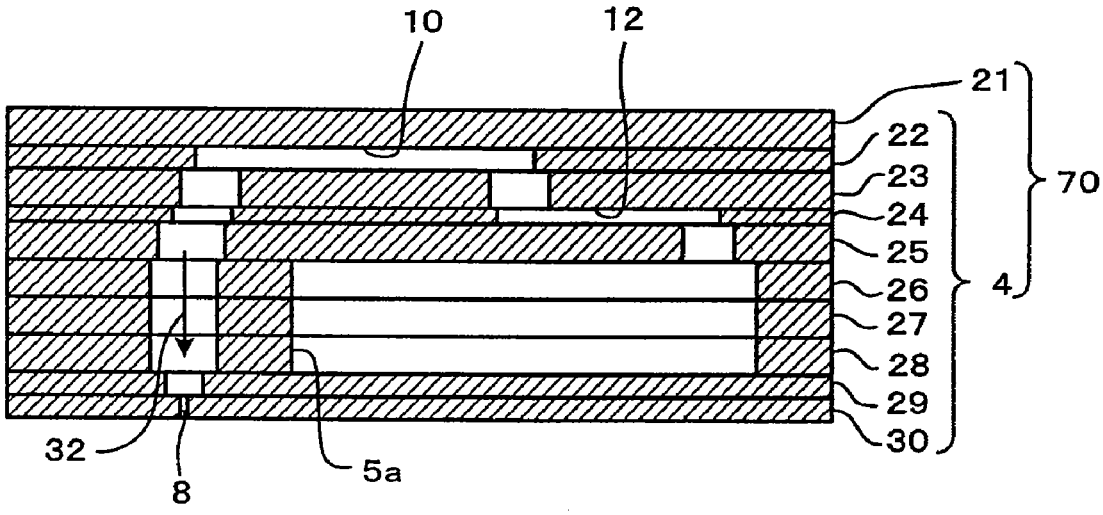
FIG. 5 is a sectional view taken along line V-V in FIG. 4.

A cross-sectional structure of the head main body 70 will be described with reference to FIGS. 1 and 5. FIG. 5 is a sectional view taken along line V-V in FIG. 4. As shown in FIGS. 1 and 5, the head main body 70 is made up of the passage unit 4 and the piezoelectric actuator 21 laminated to each other. The passage unit 4 has a layered structure of, from the top, a cavity plate 22, a base plate 23, an aperture plate 24, a supply plate 25, manifold plates 26, 27, 28, a cover plate 29, and a nozzle plate 30. All of the plates 22 to 30 are metal plates.

Formed within the passage unit 4 are ink passages that extend to the nozzles 8 at which ink supplied from outside is ejected at ink droplets. The ink passages include the manifold channels 5 and the sub manifold channels 5*a* in which ink is temporarily stored, and also include individual ink passages 32 each extending from an outlet of a sub manifold channel 5*a* through an aperture 12 and a pressure chamber 10 to a nozzle 8 formed in the nozzle plate 30, and the like. As shown in FIG. 5, the sub manifold channel 5*a* is made up of holes formed in the manifold plates 26, 27, and 28. The aperture 12 is made up of a hole formed in the aperture plate 24. The pressure chamber 10 is made up of a hole formed in the cavity plate 22. In addition, connection holes for connecting the sub manifold channels 5*a*, the apertures 12, the pressure chambers 10, and the nozzles 8 are formed in the respective plates 23 to 29. Each of the upper eight plates 22 to 29 has eight through holes which are parts of the grooves 4*a*.

The nine metal plates are positioned in layers so as to form individual ink passages 32. At this time, the through holes formed in the eight plates 22 to 29, which are parts of the grooves 4*a*, and an upper face of the nozzle plate 30 cooperate to form the grooves 4*a*. Like this, the through holes are formed in the eight plates 22 to 29 other than the nozzle plate 30, to form the grooves 4*a*. Therefore, the grooves 4*a* do not reach a lower face of the nozzle plate 30. This can realize a maximum depth of the groove 4*a* while preventing ink adhering to the lower face of the nozzle plate 30 from flowing through the groove 4*a* to the upper face of the passage unit 4.

Figure 6:
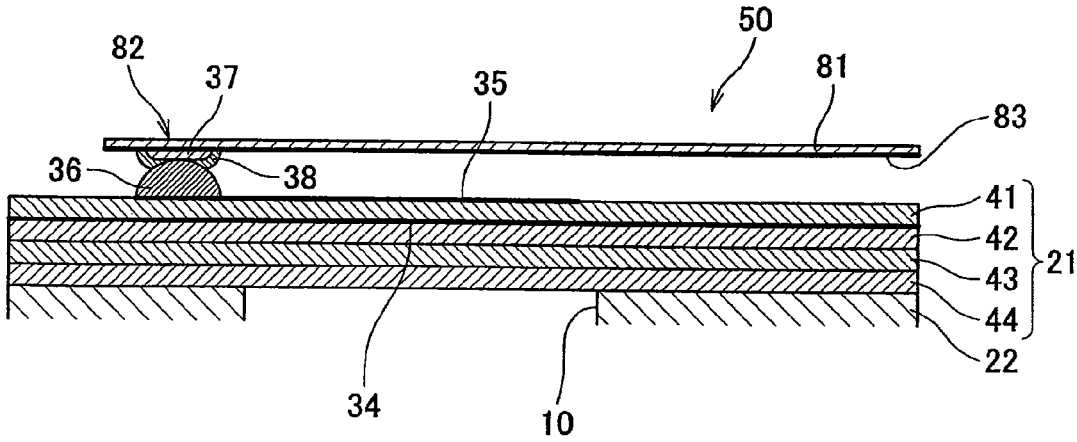
FIG. 6 shows on an enlarged scale a vicinity of a piezoelectric actuator illustrated in FIG. 5.

FIG. 6 shows on an enlarged scale a part around the piezoelectric actuator 21 illustrated in FIG. 5, including the COF 50. As shown in FIG. 6, the piezoelectric actuator 21 has a layered structure of four piezoelectric sheets 41, 42, 43, and 44. Each of the piezoelectric sheets 41 to 44 has the same thickness of approximately 15 μm, and thus the piezoelectric actuator 21 has a thickness of approximately 60 μm. Any of the piezoelectric sheets 41 to 44 is configured as a continuous layer-like flat plate so that it extends over many pressure chambers 10 formed in one ink ejection region. The piezoelectric sheets 41 to 44 are made of a lead zirconate titanate (PZT)-base ceramic material having ferroelectricity.

An individual electrode 35 having a thickness of approximately 1 μm is formed on the uppermost piezoelectric sheet 41. Both of the individual electrode 35 and a later-described common electrode 34 are made of a conductive material such as noble metals including for example Ag—Pd, Pt, Au, and the like. Similarly to the pressure chamber 10, the individual electrode 35 has a substantially rhombic shape in a plan view. The individual electrode 35 is formed so that it is opposed to the pressure chamber 10 and besides its large part falls within the pressure chamber 10 in a plan view. Consequently, substantially over a whole area on the uppermost piezoelectric sheet 41, many individual electrodes 35 are regularly arranged in two dimensions, as shown in FIG. 4. In this embodiment, the individual electrodes 35 are formed only on a surface of the piezoelectric actuator 21. Accordingly, the piezoelectric sheet 41 which is the outermost layer of the piezoelectric actuator 21 is the only layer that includes active regions. As a result, the piezoelectric actuator 21 acts as an actuator causing unimorph deformation, and can present good efficiency of deformation.

One acute portion of the individual electrode 35 extends out to a position above a beam of the cavity plate 22 which means a portion of the cavity plate 22 where the pressure chamber 10 is not formed. The beam is bonded to and supports the piezoelectric actuator 21. A land 36 is provided on an end portion of this extending-out portion. The land 36 has a substantially circular shape in a plan view, and has a thickness of approximately 15 μm. The land 36 is made of the same conductive material as the individual electrode 35 and the common electrode 34 are. The individual electrode 35 and the land 36 are electrically connected to each other.

A common electrode 34 having a thickness of approximately 2 μm is interposed between the uppermost piezoelectric sheet 41 and the piezoelectric sheet 42 disposed under the uppermost piezoelectric sheet 41. The common electrode 34 is formed in an opposed area entire with the piezoelectric sheet 41 and the piezoelectric sheet 42. As a result, the piezoelectric sheet 41 is, in its portion opposed to the pressure chamber 10, sandwiched between a pair of electrode including the individual electrode 35 and the common electrode 34. An electrode is disposed neither between the piezoelectric sheets 42 and 43 nor between the piezoelectric sheets 43 and 44.

Each of the many individual electrodes 35 is electrically connected to the driver IC chip 52 through the land 36, a bump 37, and a driving wire 83 (see FIG. 8), as will be described later. The bump 37 forms a contact area 82 on the COF 50 (see FIG. 8). On the other hand, the common electrode 34 is electrically connected to unillustrated surface electrodes via unillustrated through holes that are formed in the piezoelectric sheet 41. The surface electrodes are formed near four corners of a surface of the piezoelectric sheet 41 so as to keep away from an electrode group made up of the individual electrodes 35. Further, the surface electrodes are connected to a common wire 84 on the COF 50 (see FIG. 8). Consequently, the common electrode 34 is, in its portions corresponding to all the pressure chambers 10, equally maintained at the ground potential as the reference potential through the surface electrodes and the common wire 84. A drive signal can be selectively applied to each of the individual electrodes 35.

Figure 7:
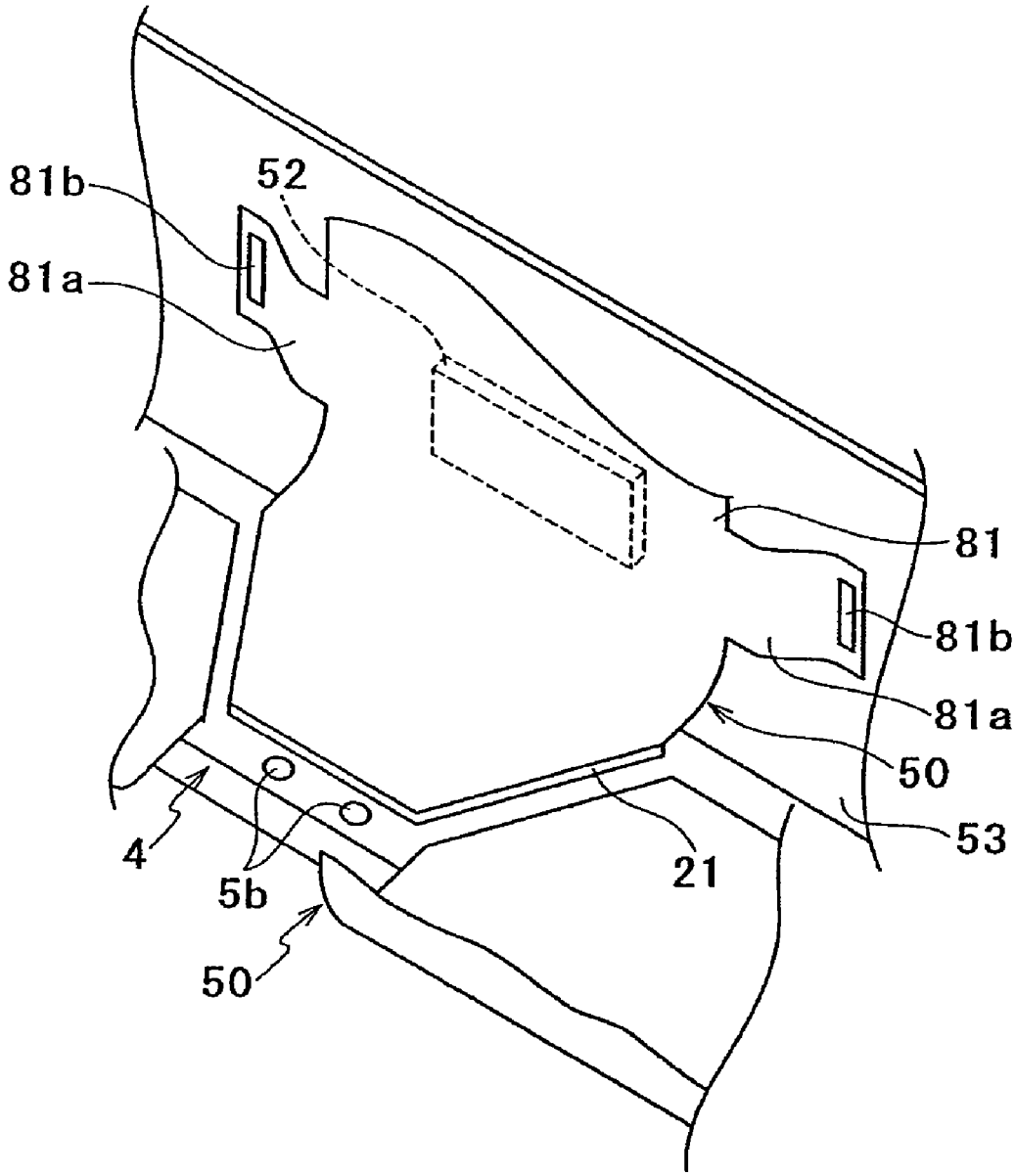
FIG. 7 is a perspective view showing a bonding state of a piezoelectric actuator, a COF, and a side plate illustrated in FIG. 1.
Figure 8:
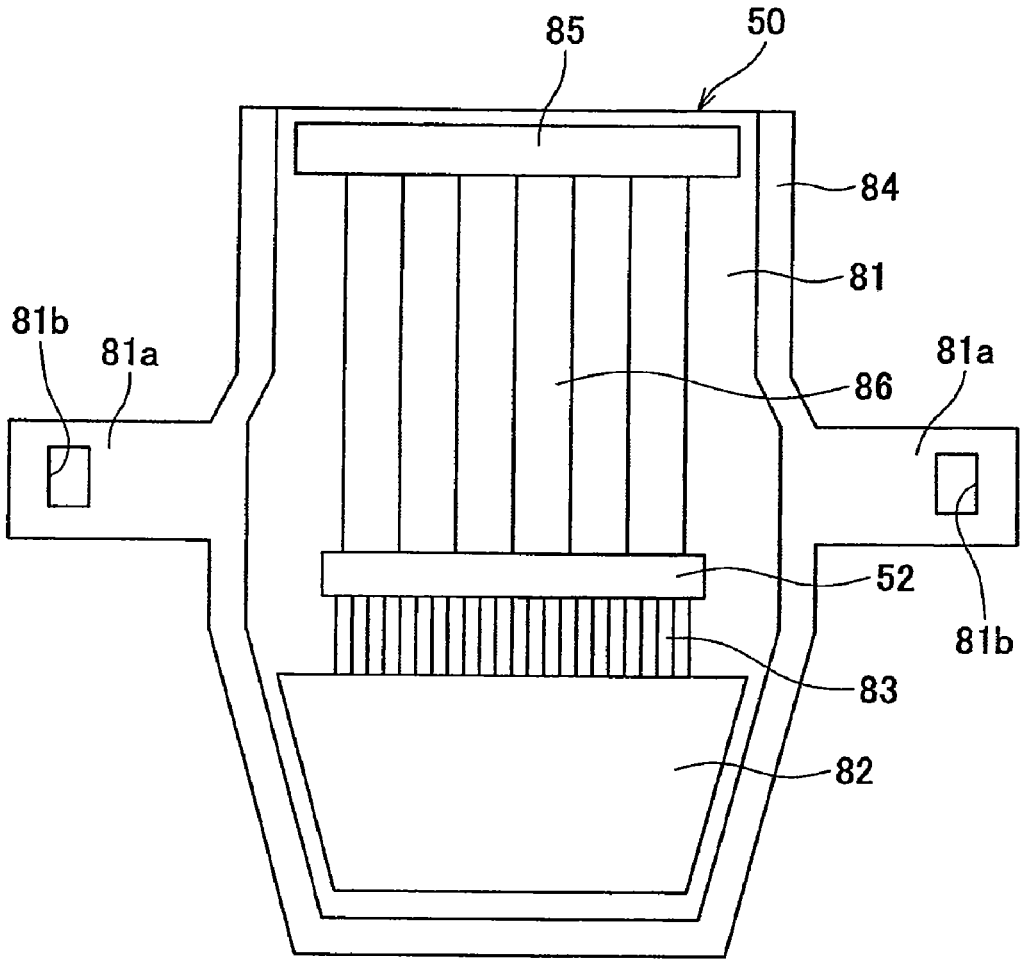
FIG. 8 is a plan view of a COF illustrated in FIG. 6.

As shown in FIGS. 1, 6, and 7, the COF 50 is disposed on the upper face of the piezoelectric actuator 21. FIG. 7 is a perspective view showing a bonding state of the piezoelectric actuator 21, the COF 50, and the side plate 53. FIG. 8 is a plan view of the COF 50. As shown in FIG. 8, the COF 50 has a sheet-like substrate 81 on one surface of which a contact area 82, driving wires 83 as a first wire, a common wire 84 as a second wire, a contact area 85, and control wires 86 are formed and in addition the driver IC chip 52 is mounted. In the contact area 82, many bumps 37 (see FIG. 6) are arranged. In the contact area 85, many contacts are formed. The COF 50 is disposed in such a manner that its surface facing this side in FIG. 8, on which the contact areas 82, 85, the wires 83, 84, 86, and the driver IC chip 52 are placed, faces downward in FIG. 6. The COF 50 is, in its portion where the driving wires 83 are formed, bent upward as shown in FIGS. 1 and 7.

The substrate 81 has protrusions 81*a* that protrude from both sides of the substrate 81 with respect to a horizontal direction in FIG. 8. The protrusions 81*a* protrude in parallel to the surface of the substrate 81, that is, protrude outward with respect to the horizontal direction in FIG. 8. As shown in FIGS. 1 and 7, a protruding end portion of the protrusion 81*a* is bonded to the side plate 53. As shown in FIG. 7, the two protrusions 81*a* are bonded to the side plate 53 while being aligned on a horizontal line. The two protrusions 81*a* may not necessarily be formed on both sides of the substrate 81, but may be formed side by side for example. In addition, the number of protrusions 81*a* is not limited to two. Further, it may not be necessary that they are bonded to the side plate 53 while being aligned on a horizontal line. Still further, although in this embodiment the protrusions 81*a* are bonded to the side plate 53 by means of a double-stick tape having conductivity, the protrusions 81*a* and the side plate 53 may be bonded directly by soldering.

A sprocket hole 81*b* is formed in a front end portion of the protrusion 81*a*. The substrate 81 is prepared by being cut out from a Tape Automated Bonding (TAB) tape. The sprocket hole 81*b* is formed in the TAB tape in order to convey the TAB tape. The sprocket hole 81*b* is used for positioning when the COF 50 is affixed to the piezoelectric actuator 21 and when the protrusions 81*a* are bonded to the side plate 53.

In the contact area 82, bumps 37 are formed corresponding to the respective lands 36 as shown in FIG. 6. A lower face of the bump 37 is covered with a solder 38, so that the land 36 and the bump 37 are electrically connected to each other by the solder 38. At this time, the land 36 and the bump 37 are physically bonded to each other by the solder 38, too. Consequently, the COF 50 is affixed to the piezoelectric actuator 21. The bump 37 is, in its upper face, electrically connected to the driving wire 83.

The driving wire 83 is electrically connected to the bump 37 as described above, and besides connected to the driver IC chip 52. Through the driving wire 83, the bump 37, and the land 36, the driver IC chip 52 controls a potential of the individual electrode 35. That is a drive potential is applied to an individual electrode 35.

The driver IC chip 52 controls a potential of the individual electrode 35 through the driving wire 83, and at the same time maintains the common electrode 34 at the ground potential. As shown in FIGS. 1 and 7, the driver IC chip 52 is disposed so as to be opposed to the side plate 53, and its surface opposite to the substrate 81 is, via an unillustrated heat dissipation sheet, in contact with and thermally coupled to a surface of the side plate 53. As shown in FIG. 1, a sponge 51 is disposed between the substrate 81 and the reservoir unit 71.

The sponge 51 is bonded to a side face of a later-described filter plate 92 of the reservoir unit 71. The substrate 81 is in contact with the sponge 51. Elastic force of the sponge 51 makes the driver IC chip 52 pressed to the side plate 53, thereby increasing the thermal coupling between the driver IC chip 52 and the side plate 53 to a sufficient extent.

As shown in FIG. 8, the common wire 84 is formed along an outer edge of the substrate 81 including the protrusions 81*a*. The common wire 84 is electrically connected to the unillustrated surface electrodes described above, and also electrically connected to the driver IC chip 52 through the circuit board 54 as will be described later so that the driver IC chip 52 maintains the common wire 84 at the ground potential. As a consequence, the common electrode 34, which is electrically connected to the surface electrodes, is always maintained at the ground potential.

As described above, the front end portion of the protrusion 81*a* is bonded to the side plate 53 made of a metal. That is, a portion of the common wire 84 formed on a surface of the protrusion 81*a* is bonded, i.e., electrically connected and thermally coupled, to the side plate 53. As a result, heat generated in the COF 50 can efficiently be dissipated to outside via the common wire 84 and the side plate 53 that also functions as a heat sink. The common wire 84 is formed along the outer edge of the substrate 81 so as to enclose the other wires and the driver IC chip 52, and at the same time bonded to the metal-made, conductive side plate 53. Accordingly, the common wire 84 functions as a shield which can suppress radiation of noise generated in the other wires and the driver IC chip 52.

Unillustrated terminals are formed in the contact area 85. The terminals correspond to the control wires 86, and connected to the connector 54*a* of the circuit board 54. The control wire 86 is connected to the driver IC chip 52 and to the terminal of the contact area 85. Through the contact area 85 and the control wires 86, the circuit board 54 controls the driver IC chip 52. The control wires 86 include a wire for supplying a power supply voltage to the driver IC chip 52, and wires for connecting the common wire 84 to the driver IC chip 52 through the circuit board 54 as described above.

Here, an operation of the piezoelectric actuator 21 will be described. In the piezoelectric actuator 21, among the four piezoelectric sheets 41 to 44, only the piezoelectric sheet 41 is polarized in a direction oriented from the individual electrode 35 toward the common electrode 34. When the driver IC chip 52 gives a predetermined potential to an individual electrode 35, a potential difference occurs in a portion of the piezoelectric sheet 41 sandwiched between the individual electrode 35 thus given the potential and the common electrode 43 maintained at the ground potential, that is, in an active portion of the piezoelectric sheet 41. Accordingly, an electric field in a thickness direction of the piezoelectric sheet 41 is generated in the active portion of the piezoelectric sheet 41. Thus, by a transversal piezoelectric effect, the active portion of the piezoelectric sheet 41 contracts in a direction perpendicular to a polarization direction. The other piezoelectric sheets 42 to 44 do not contract because the electric field is not applied thereto. As a result, portions of the piezoelectric sheet 41 to 44 opposed to the active portion as a whole present unimorph deformation protruding toward a corresponding pressure chamber 10. The volume of the pressure chamber 10 decreases accordingly, and ink rises in pressure so that an ink droplet is ejected from a corresponding nozzle 8 shown in FIG. 4. Then, at a timing when the individual electrode 35 returns to the ground potential, the piezoelectric sheets 41 to 44 restore their original shapes, and the pressure chamber 10 restores its original volume. Thus, ink is sucked from a sub manifold channel 5*a* into an individual ink passage 32.

In another possible driving mode, a predetermined potential is in advance given to an individual electrode 35. Upon every ejection request, the individual electrode 35 is set at the ground potential and then at a predetermined timing given the predetermined potential again. In this mode, at a timing of setting the individual electrode 35 at the ground potential, the piezoelectric sheets 41 to 44 return to their original state, so that volume of a corresponding pressure chamber 10 becomes larger than in the initial state where voltage has been applied in advance. Thereby, ink is sucked from a sub manifold channel 5*a* into an individual ink passage 32. Then, at a timing of giving the predetermined potential again to the individual electrode 35, the portion of the piezoelectric sheets 41 to 44 corresponding to the active portion deforms protrudingly toward the corresponding pressure chamber 10. The volume of the pressure chamber 10 decreases accordingly, and ink rises in pressure so that an ink droplet is ejected from a corresponding nozzle 8.

Figure 9:
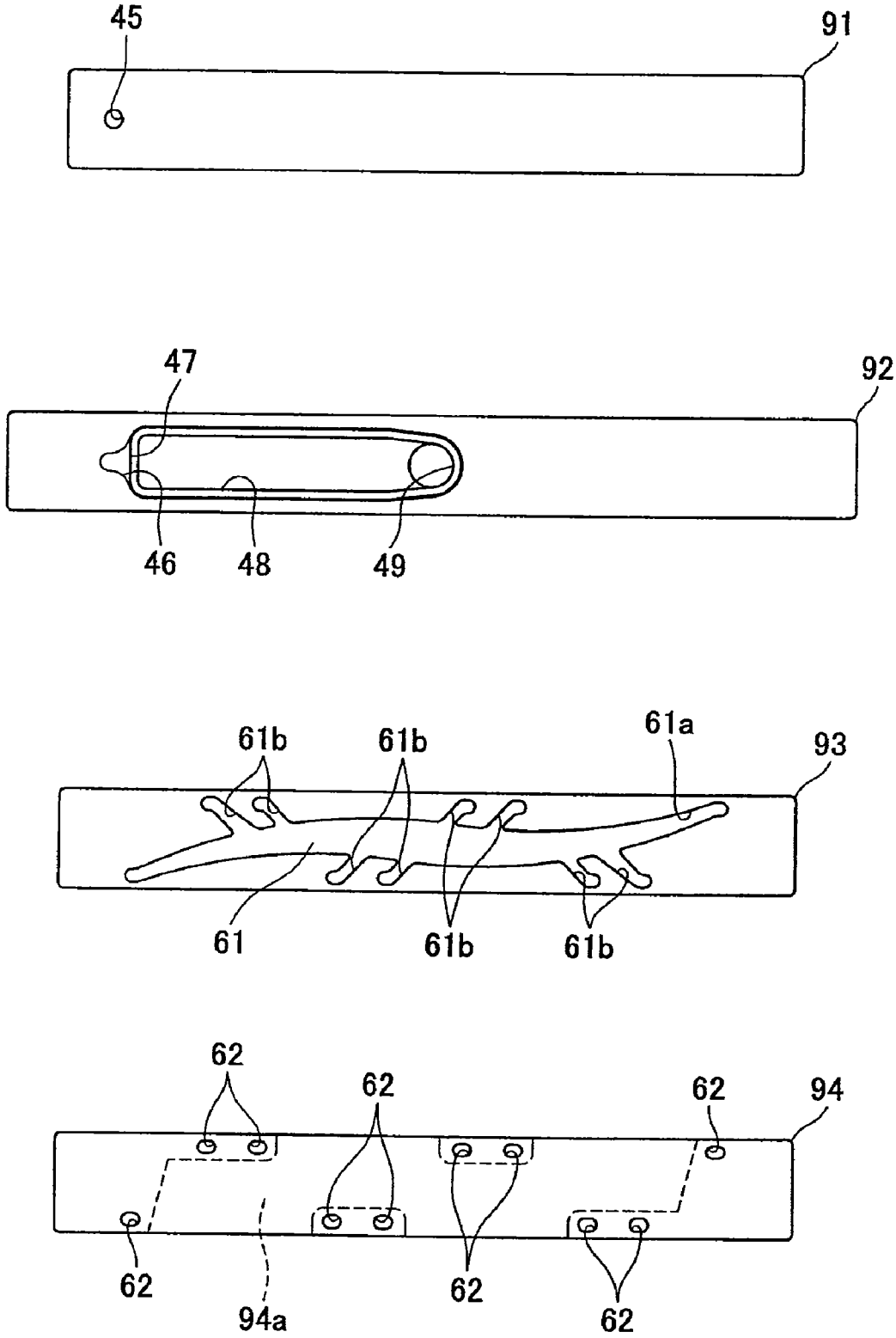
FIG. 9 is plan views of four plates that constitute a reservoir unit illustrated in FIG. 1.
Figure 10:
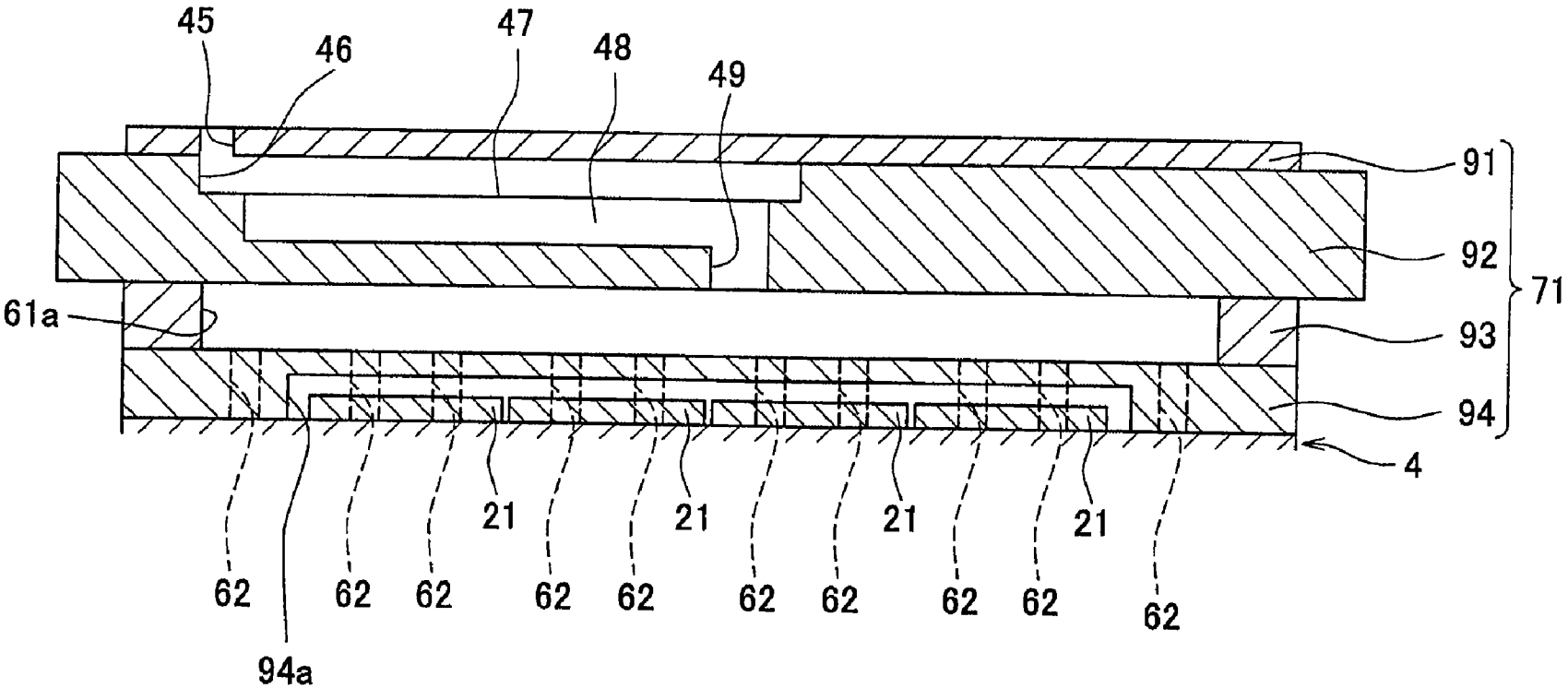
FIG. 10 shows the four plates illustrated in FIG. 9 that are put in layers and vertically sectioned along their longitudinal direction.

Next, the reservoir unit 71 will be described in more detail with reference to FIGS. 1, 9, and 10. FIG. 9 is plan views of four plates that constitute the reservoir unit 71 illustrated in FIG. 1, that is, plan views of an upper plate 91, a filter plate 92, a reservoir plate 93, and an under plate 94. FIG. 10 shows the four plates 91 to 94 illustrated in FIG. 9 that are put in layers and vertically sectioned along a longitudinal direction of the reservoir unit 71.

As shown in FIG. 10, the reservoir unit 71 is made up of four plates positioned to each other and put in layers. The four plates are, from a top side, an upper plate 91, a filter plate 92, a reservoir plate 93, and an under plate 94. Each of the four plates 91 to 94 is a flat plate of substantially rectangular shape, and its longitudinal direction is the same as the longitudinal direction of the passage unit 4. A width of the four plates 91 to 94 is smaller than a distance between the two side plates, as shown in FIG. 1. As shown in FIGS. 9 and 10, a hole 45 is formed near one longitudinal end, i.e., a left side end in FIG. 10, of the upper plate 91. An unillustrated ink tank supplies ink through the hole 45.

As shown in FIGS. 9 and 10, the filter plate 92 has a hole 46 that is formed on an upper face of the filter plate 92 and extends downward. A depth of the hole 46 is approximately one third of a thickness of the filter plate 92. The hole 46 extends from a point opposed to the hole 45, in a longitudinal direction of the filter plate 92, substantially to a center portion of the filter plate 92. One end portion, i.e., a left side end in FIG. 10, of the hole 46 communicates with the hole 45. A filter 47 is disposed over an entire area of a bottom face of the hole 46.

A hole 48 is formed under the hole 46 with the filter 47 sandwiched therebetween. A depth of the hole 48 is approximately one third of the thickness of the filter plate 92. In a plan view, a shape of the hole 48 is slightly smaller than that of the hole 46. A hole 49 is formed on a bottom face of the hole 48. The hole 49 locates under one longitudinal end, i.e., a right side end in FIG. 10, of the hole 48. A depth of the hole 49 is approximately one third of the thickness of the filter plate 92. The hole 49 opens in a lower face of the filter plate 92. Through the hole 49, the hole 48 communicates with a hole 61 which will be described later.

As shown in FIGS. 9 and 10, a hole 61 is formed in the reservoir plate 93. The hole 61 is made up of a main passage 61*a* and eight branch passages 61*b*. The main passage 61*a* extends longitudinally in a central portion of the reservoir plate 93. In the middle of the main passage 61*a*, the eight branch passages 61*b* are branched. One end, i.e., a left side end in FIG. 9, of the main passage 61*a* bend downward in FIG. 9, and the other end thereof, i.e., a right side end in FIG. 9, bend upward in FIG. 9. These two ends are respectively opposed to, among ten holes 62 formed in the under plate 94 as will be described later, the holes 62 positioned at both longitudinal ends of the under plate 94. The eight branch passages 61*b* extend to positions each opposed to each of the other eight holes 62. Here, the hole 61 serves as an ink reservoir in which ink is stored.

As shown in FIGS. 9 and 10, ten holes 62 each having a substantially circular shape in a plan view are formed in the under plate 94. The holes 62 communicate with the hole 61. The holes 62 are provided at both widthwise end portions of the under plate 94, so as to correspond to the ink supply ports 5*b* of the passage unit 4. In addition, a lower face of the under plate 94 has a cavity 94*a*. A portion of the lower face of the under plate 94 other than both longitudinal end portions and portions surrounding the respective holes 62 is reduced in thickness to thereby form the cavity 94*a*. The reservoir unit 71 is fixed to the passage unit 4 via the both longitudinal end portions and the portions surrounding the respective holes 62. At this time, the portion of the under plate 94 where the cavity 94*a* is formed cooperates with the passage unit 4 to define a gap as shown in FIG. 1. In this gap, the piezoelectric actuator 21 is bonded to a surface of the passage unit 4 with a narrow space formed between the piezoelectric actuator 21 and the under plate 94.

In the reservoir unit 71, the hole 45 communicates with the holes 62 through the hole 46, the filter 47, the hole 48, the hole 49, and the hole 61. Thus, ink supplied from the ink tank to the hole 45 is filtered through the filter 47, flows into the holes 62, and supplied to the passage unit 4 through the ink supply ports 5*b* that communicate with the holes 62.

In the above-described embodiment, since the front end portions of the protrusions 81*a* of the substrate 81 are bonded to the side plate 53, the common wire 84 is bonded to the metal-made side plate 53 that functions also as a heat sink. Consequently, heat generated in the COF 50 can efficiently be dissipated to outside through the side plate 53. In addition, since the common wire 84 bonded to the metal-made, conductive side plate 53 is formed along the outer edge of the substrate 81, the common wire 84 functions as a shield that can suppress radiation of noise generated in the COF 50.

Since the protrusions 81*a* protrude from the substrate 81 in the direction parallel to the surface of the substrate 81, it is easy to bond the protrusions 81*a* to the side plate 53. Besides, the protrusions 81*a* are formed at both sides of the substrate 81. Therefore, when the protrusions 81*a* are bonded to the side plate 53, force applied to the substrate 81 can be dispersed and damage to the substrate 81 can be prevented, as compared with when, for example, the two protrusions 81*a* are formed side by side at one side of the substrate 81. Moreover, the two protrusions 81*a* are bonded to the side plate 53 while being aligned on a horizontal line. As a result, the two protrusions 81*a* and therearound are uniformly stressed, so that damage to the substrate 81 can more surely be prevented.

Next, modifications of this embodiment will be described. Members having the same constructions as in the above-described embodiment will be denoted by the common reference numerals, and descriptions thereof will appropriately be omitted.

Figure 11:
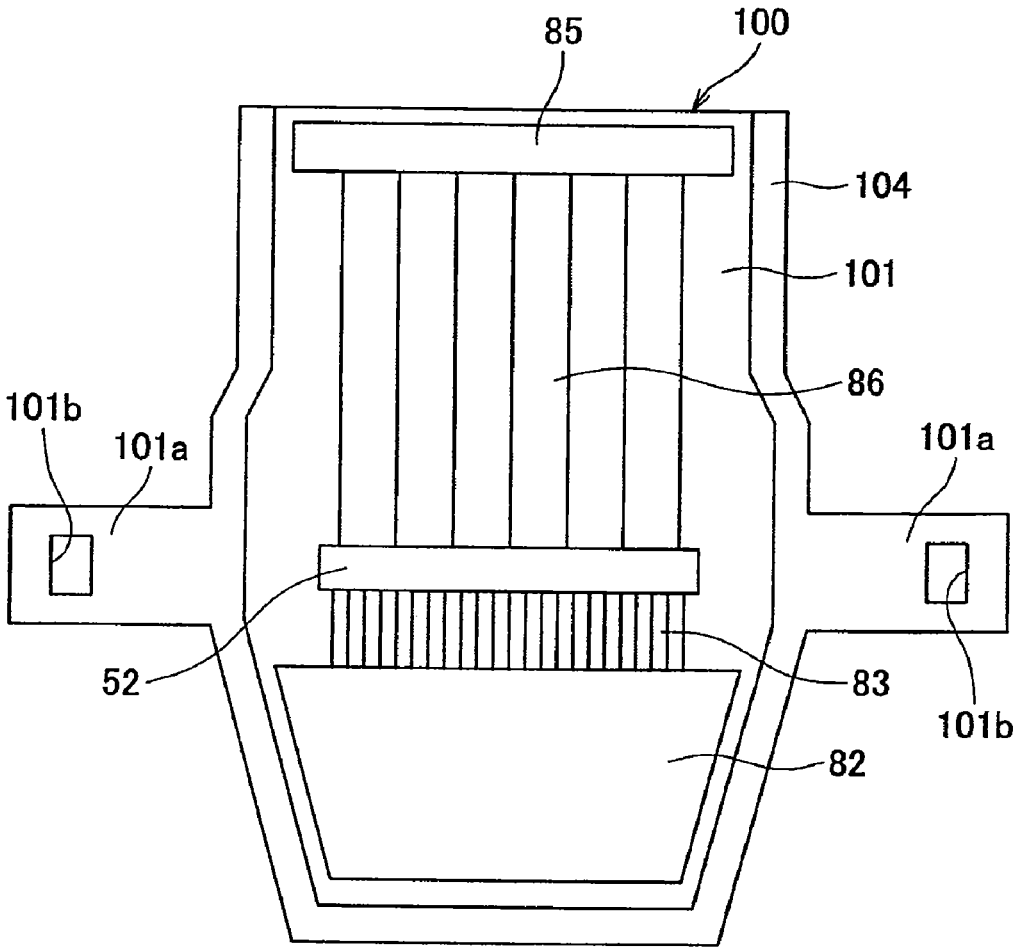
FIG. 11 is a plan view corresponding to FIG. 8 and showing a first modification.

In one modification, as shown in FIG. 11, two protrusions 101*a* and a driver IC chip 52 provided on a substrate 101 of a COF 100 are aligned on the same line that is parallel to a longitudinal direction of the driver IC chip 52. A portion of a common wire 104 formed on the protrusion 101*a* is bonded to a side plate 53 like in the above-described embodiment (see FIG. 1). That is, in this modification, the two protrusions 101*a* are bonded to the side plate 53 so that the two protrusions 101*a* and the driver IC chip 52 are aligned on a horizontal line. As a result, rigidity is improved in the vicinity of the protrusion 101*a*. Therefore, the protrusion 101*a* can more surely be prevented from being damaged when, for example, it is bonded to the side plate 53. A sprocket hole 101*b* of the protrusion 101*b* is, like the sprocket hole 81*b* of the embodiment (see FIG. 8), formed in a TAB tape. The sprocket hole 101*b* is used for positioning when the COF 100 is affixed to a piezoelectric actuator 21 and when the protrusions 101*a* are bonded to the side plate 53. As described above, rigidity is improved in the vicinity of the protrusion 101*a* having the sprocket hole 101*b* formed therein. Therefore, accurate positioning can be realized.

Figure 12:
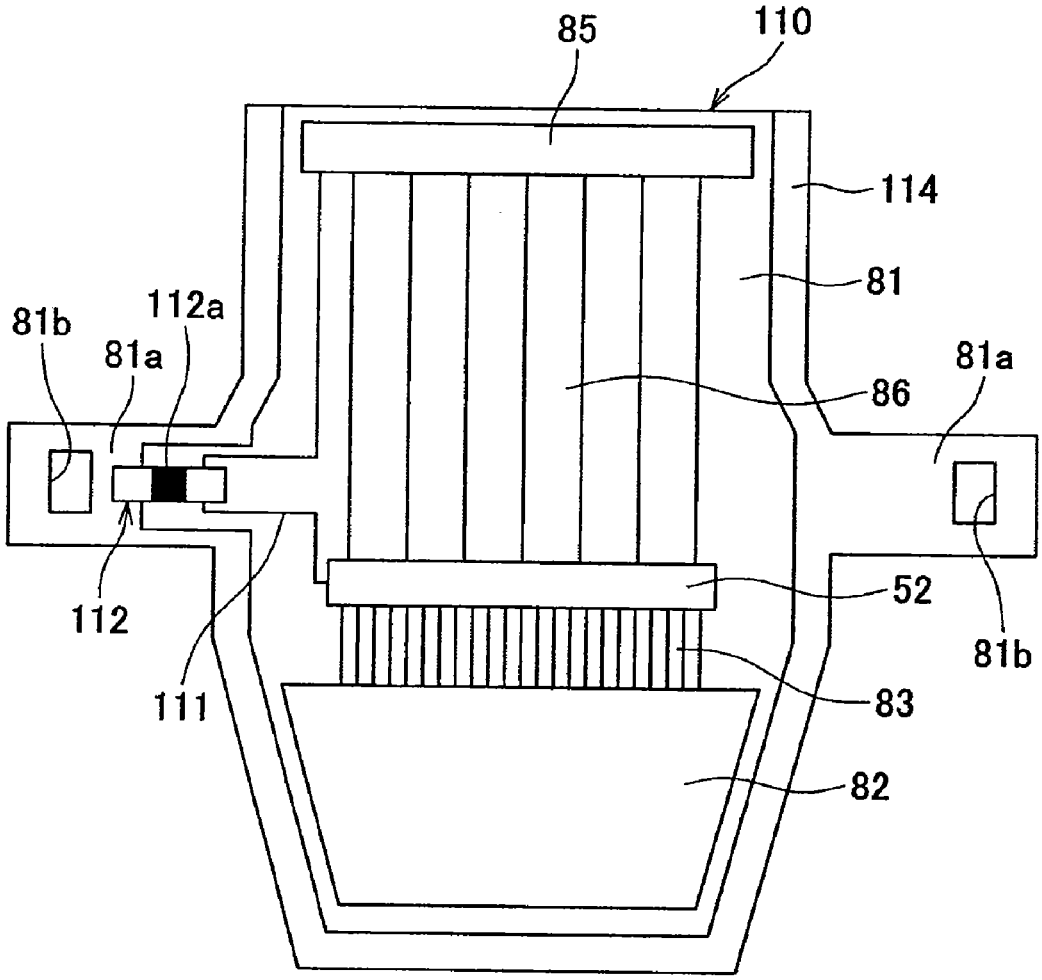
FIG. 12 is a plan view corresponding to FIG. 8 and showing a second modification.

In another modification, as shown in FIG. 12, one of two protrusions 81*a*, i.e., the protrusion 81*a* at a left side in FIG. 12, has a portion where a common wire 114 is not formed. In this portion, a solder point 112 that connects the common wire 114 to a ground wire 111 as a third wire is disposed (second modification). Here, the ground wire 111 is formed on a surface of a substrate 81, and connected to a driver IC chip 52. The driver IC chip 52 maintains the ground wire 111 at the ground potential. A solder 112*a* provided substantially at a center of the solder point 112 enables the solder point 112 to connect the common wire 114 to the ground wire 111. In a manufacturing process during which the solder 112*a* has not been provided yet, a common electrode 34 (see FIG. 6) is set at a potential lower than the ground potential through the common wire 114 while the same drive potential as used in driving is given to all individual electrodes 35, so that a potential difference that is larger than in driving occurs in a piezoelectric sheet 41 to thereby polarize the piezoelectric sheet 41. Then, the solder 112*a* is provided to connect the common wire 114 to the ground wire 111. Thus, the common wire 114 is maintained at the ground potential.

In this case, since the solder point 112 is provided on the protrusion 81*a*, not only the common wire 114 but also the solder point 112 is bonded to the side plate 53 (see FIG. 1). This allows heat generated in the COF 110 to be efficiently dissipated to outside through the side plate 53, and besides can suppress radiation of noise. Moreover, since the solder point 112 is formed on the COF 110, a loop between the driver IC chip 52 and a piezoelectric actuator 21 is shortened. As a result, noise occurring in the loop can be reduced. In the second modification, the solder point 112 is disposed at only one of the two protrusions 81*a*. However, it may be possible that solder points 112 are provided at both of the two protrusions 81*a*.

Figure 13A:
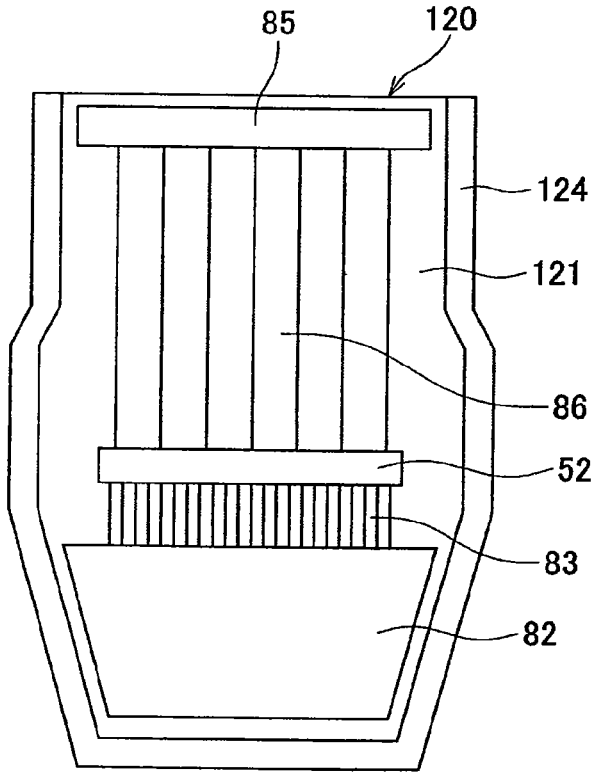
FIG. 13A is a plan view corresponding to FIG. 8 and showing a third modification.
Figure 13B:
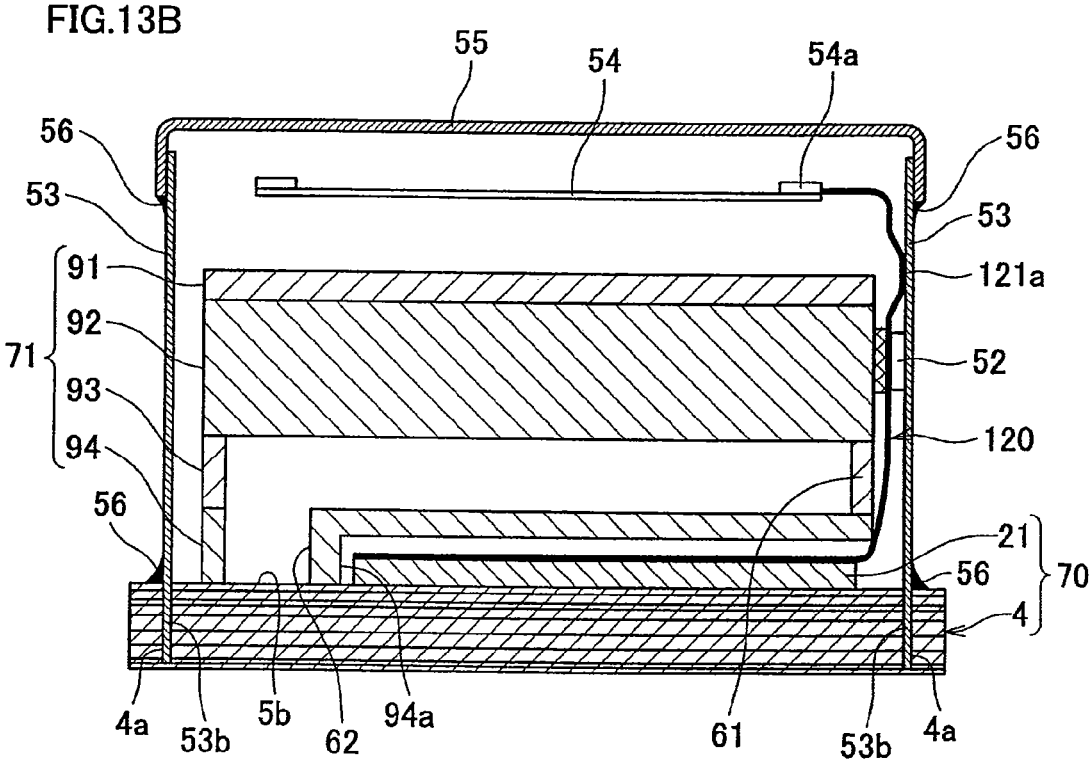
FIG. 13B is a sectional view corresponding to FIG. 1 and showing the third modification.

FIGS. 13A and 13B show still another modification. In this modification, as shown in FIG. 13A, protrusions 81*a* (see FIG. 8) are not formed on a substrate 121 of a COF 120. As shown in FIG. 13B, a joint portion 121*a*, which is a part of the substrate 121 of the COF 120 existing where the COF 120 is opposed to a side plate 53, is bent toward the side plate 53. In the joint portion 121*a*, the COF 120 is bonded to the side plate 53 (third modification). In this case as well, a portion of a common wire 124 formed on a surface of the joint portion 121*a* is bonded to the side plate 53. This allows heat generated in the COF 120 to be efficiently dissipated to outside through the side plate 53, and besides can suppress radiation of noise generated din the COF 120. In this case, a driving wire 83 and a control wire 86 are covered with an insulating layer in order to prevent an electrical short-circuit between these wires and the side plate 53.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit having a pressure chamber that communicates with an ink ejection port;

a piezoelectric actuator that applies pressure to ink in the pressure chamber, and has an individual electrode formed so as to be opposed to the pressure chamber, a common electrode formed so as to be opposed to the individual electrode, and a piezoelectric layer sandwiched between the individual electrode and the common electrode;

a wire member having a substrate, a first wire that is formed on a surface of the substrate and electrically connected to the individual electrode, a second wire that is formed on the surface of the substrate and electrically connected to the common electrode, and a driver IC chip that is mounted on the surface of the substrate, gives a drive potential to the individual electrode through the first wire, and maintains the common electrode at a predetermined reference potential through the second wire; and a heat sink made of a metal material which is in contact with the driver IC chip and dissipates heat generated in the driver IC chip to outside, wherein the second wire is formed along an outer edge of the substrate, and electrically connected and thermally coupled to the heat sink.

2. The ink-jet head according to claim 1, wherein:

the substrate has a protrusion that protrudes outward from the outer edge of the substrate in a direction parallel to the surface of the substrate; and in the protrusion, the second wire is bonded to the heat sink.

3. The ink-jet head according to claim 2, wherein the protrusion is formed at each of both sides of the substrate.

4. The ink-jet head according to claim 3, wherein, two protrusions bonded to the heat sink are aligned on a horizontal line.

5. The ink-jet head according to claim 4, wherein, on the surface of the substrate, the two protrusions and the driver IC chip are aligned on the same line.

6. The ink-jet head according to claim 2, wherein:

the wire member further has a third wire that is electrically connected to the driver IC chip, brought close to the second wire in the protrusion, and maintained at the reference potential by the driver IC chip, and a solder point that is formed in the protrusion and able to cause a short-circuit between the second wire and the third wire; and the second wire is maintained at the reference potential through the third wire and the solder point during the solder point is short-circuited.

* * * * *